US008484878B2

(12) United States Patent
Borkowski

(10) Patent No.: US 8,484,878 B2
(45) Date of Patent: Jul. 16, 2013

(54) FIREARM STABILIZATION APPARATUS

(76) Inventor: Brian Borkowski, Vicksburg, MS (US)

( * ) Notice: Subject to any disclaimer, the term of this patent is extended or adjusted under 35 U.S.C. 154(b) by 15 days.

(21) Appl. No.: 12/631,395

(22) Filed: Dec. 4, 2009

(65) Prior Publication Data

US 2011/0131860 A1 Jun. 9, 2011

(51) Int. Cl.
*F41C 27/00* (2006.01)

(52) U.S. Cl.
USPC ..... 42/94; 42/72; 89/36.05; 2/2.25; 2/459

(58) Field of Classification Search
USPC ..... 89/36.05; 2/2.5, 459
See application file for complete search history.

(56) References Cited

U.S. PATENT DOCUMENTS

| | | | | |
|---|---|---|---|---|
| 3,257,666 | A * | 6/1966 | Hoffman | 2/459 |
| 3,504,377 | A * | 4/1970 | Biggs, Jr. et al. | 2/462 |
| 4,353,133 | A * | 10/1982 | Williams | 2/459 |
| 4,493,115 | A * | 1/1985 | Maier et al. | 2/459 |
| 4,514,862 | A * | 5/1985 | A'Costa | 2/459 |
| 4,610,034 | A * | 9/1986 | Johnson | 2/459 |
| 4,642,815 | A * | 2/1987 | Allen | 2/459 |
| 4,669,125 | A * | 6/1987 | Allen | 2/459 |
| 5,431,318 | A * | 7/1995 | Garcia | 224/192 |
| 5,590,826 | A * | 1/1997 | Endo | 224/264 |
| 6,588,023 | B1 * | 7/2003 | Wright | 2/459 |
| D522,214 | S * | 6/2006 | Noell | D2/836 |
| 7,424,748 | B1 * | 9/2008 | McDunn et al. | 2/2.5 |
| 7,434,301 | B1 * | 10/2008 | Johnson | 29/45 |
| 7,520,206 | B2 * | 4/2009 | Baker | 89/36.06 |
| 2003/0110933 | A1 * | 6/2003 | Baker | 89/36.05 |
| 2010/0005555 | A1 * | 1/2010 | Osborne | 2/2.5 |
| 2010/0269234 | A1 * | 10/2010 | Bennett | 2/2.5 |
| 2011/0055992 | A1 * | 3/2011 | Roux | 2/2.5 |
| 2011/0072545 | A1 * | 3/2011 | Bennett | 2/2.5 |
| 2011/0072546 | A1 * | 3/2011 | Taylor et al. | 2/2.5 |
| 2011/0072565 | A1 * | 3/2011 | Krueger | 2/459 |
| 2011/0093996 | A1 * | 4/2011 | Henriquez | 2/2.5 |
| 2011/0113520 | A1 * | 5/2011 | Dennis | 2/2.5 |
| 2011/0145965 | A1 * | 6/2011 | Hirano | 2/2.5 |
| 2011/0209260 | A1 * | 9/2011 | Herbener et al. | 2/2.5 |
| 2011/0214212 | A1 * | 9/2011 | Marx et al. | 2/2.5 |

OTHER PUBLICATIONS

"UK Releases New Helmet and Armor," Soldier Systems An Industry Daily [online], available Jun. 27, 2009 [retrieved on Mar. 4, 2010], retrieved from Soldier Systems website using Internet <URL: http://soldiersystems.net/2009/06/27/uk-releases-new-helmet-and-armor/ >.

* cited by examiner

*Primary Examiner* — Samir Abdosh
(74) *Attorney, Agent, or Firm* — Jeremy A. Smith; Frank M. Caprio; Bradley Arant Boult Cummings LLP

(57) ABSTRACT

The present disclosure relates to firearms and more specifically an apparatus and method useful in positioning and stabilizing shoulder-fired firearms. In one embodiment, the apparatus includes a front portion, said front portion further comprising a curved medial side, a lateral side, a front panel and a stabilizing element. In a further embodiment, the apparatus is reversibly attached to a body armor.

12 Claims, 6 Drawing Sheets

FIREARM STABILIZATION APPARATUS

FIELD OF THE DISCLOSURE

The present disclosure relates to a firearm stabilization apparatus. The present disclosure further relates to a firearm stabilization apparatus which allows a user to properly seat the firearm in their shoulder pocket while wearing body armor. In one embodiment, the firearm stabilization apparatus is reversibly attached to a body minor. In an alternate embodiment, the firearm stabilization apparatus is integrated into the left or right shoulder regions of the body armor.

BACKGROUND

Body armor (also known as a bullet proof vest) is protective gear designed to stop projectiles including bullets and shrapnel. Body armor is used by police, military personnel and private security services. Generally there are two distinct groups of body armors, that used by police officers and that used by the military or other high risk groups, such as the Secret Service.

Among the first group, there are different types of body armor characterized by increasing protection power. Generally, Type I body armor protects against .22 long rifle lead round nose bullets, with nominal masses of 2.6 g, impacting at a minimum velocity of 320 m/s or less. Type II body armor protects against 9 mm full metal jacketed round nose bullets, with nominal masses of 8.0 g, impacting at a minimum velocity of 332 m/s or less. Type III body armor protects against 9 mm full metal jacketed round nose bullets, with nominal masses of 8.0 g, impacting at a minimum velocity of 427 m/s or less. Finally, Type IV body armor protects against .30 caliber armor piercing (AP) bullets (U.S. military designation M2 AP), with nominal masses of 10.8 g (166 gr), impacting at a minimum velocity of 869 m/s (2850 ft/s) or less. It also provides at least single-hit protection against the Type I through III threats. Type I-IV armors are often soft armors.

Body armors for high risk groups (military personnel for example) are, at the moment, not soft armors. One example of body armor used by the Army is the Improved Outer Tactical Vest (IOTV) 34 which replaced the older Interceptor body armor. The IOTV, as shown in FIGS. 1 and 2, includes a front protector 42, a back protector 44 and may optionally include neck protectors 40 and/or side protectors 46. A soldier may don the IOTV in two ways. The first is to simply place the IOTV over the head and pull down, and the second is to remove fasteners on the soldier's left shoulder, sliding into the vest to the right. To complete the procedure for both methods, the soldier then lifts up the front panel of the vest and fastens a waistband, which takes the weight of the IOTV off the shoulders somewhat, and then fastens the side protection modules. A key design feature for the IOTV is that the entire system is able to be released with the pull of a hidden lanyard. The armor then falls apart into its component pieces, providing a means for escape in case the soldier falls into water or becomes trapped in a hazardous environment. The hidden release lanyard also allows medical personnel easier access to an injured soldier, which was one concern that was not addressed with the old Interceptor armor.

The IOTV is designed to take the weight of the vest off the shoulders and move it to the lower torso. The IOTV may also be equipped with a mesh inner cover that is designed to improve airflow inside of the armor. There is also a back pad in the lower back area of the vest, which is designed to defeat fragmentation impacts to the lower back/kidney areas. The IOTV can withstand a direct impact from a 7.62 millimeter (both NATO and ex-Soviet types) on the front or rear trauma plates. The IOTV provides, without the ballistic ceramic plates inserted, protection from small caliber rounds (i.e. 9 mm) and fragmentation, much the same as the fragmentation vest or "flak jacket" used since the Vietnam Conflict.

One shortcoming of the IOTV, and most other body armors, is the inability to correctly position and stabilize a firearm. Still referring to FIGS. 1 and 2, the right and left shoulder regions 36, 38 and bulky and cumbersome. The Army Field Manual teaches that soldiers should position the butt of their firearm (such as an M16 or M4) in the crease between their shoulder and chest (the so called "pocket"). Further, military patrols are taught to maintain their firearms in the firing position for quick and responsive firing on patrol. The present invention provides a firearm stabilization pad that allows the user to seat the firearm in the shoulder pocket correctly.

BRIEF DESCRIPTION OF THE DRAWINGS

To further advantages and features of the present disclosure, a more particular description of the invention will be rendered by reference to specific embodiments thereof which are illustrated in the appended drawings. It is appreciated that these drawings are not to be considered limiting in scope. The invention will be described and explained with additional specificity and detail through the use of the accompanying drawings in which.

SUMMARY

Figure 1:
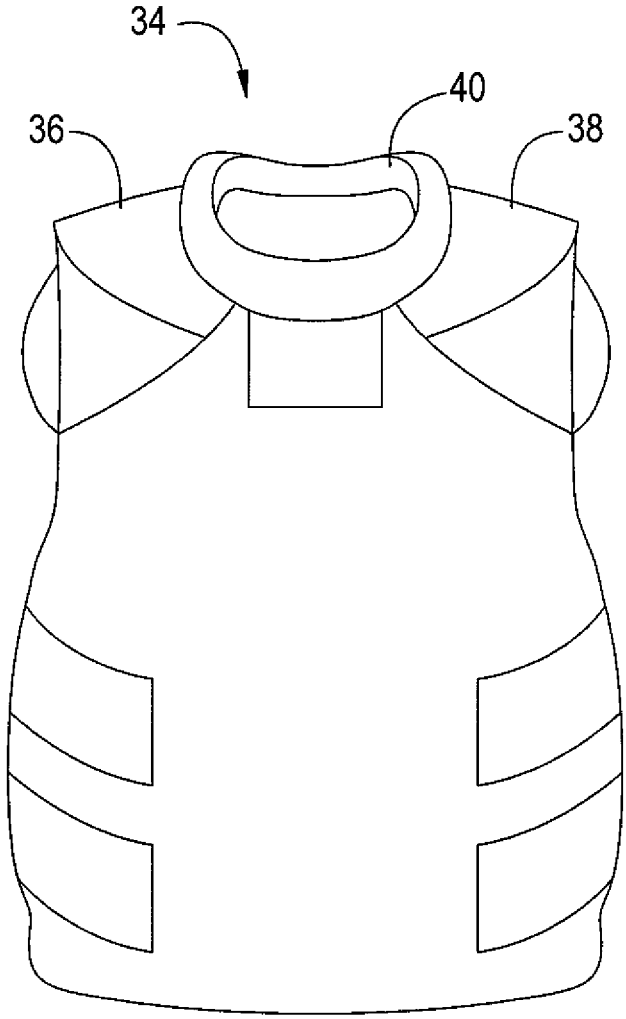
FIG. 1 Prior Art
FIG. 1 shows one embodiment of a prior art IOTV.
Figure 2:
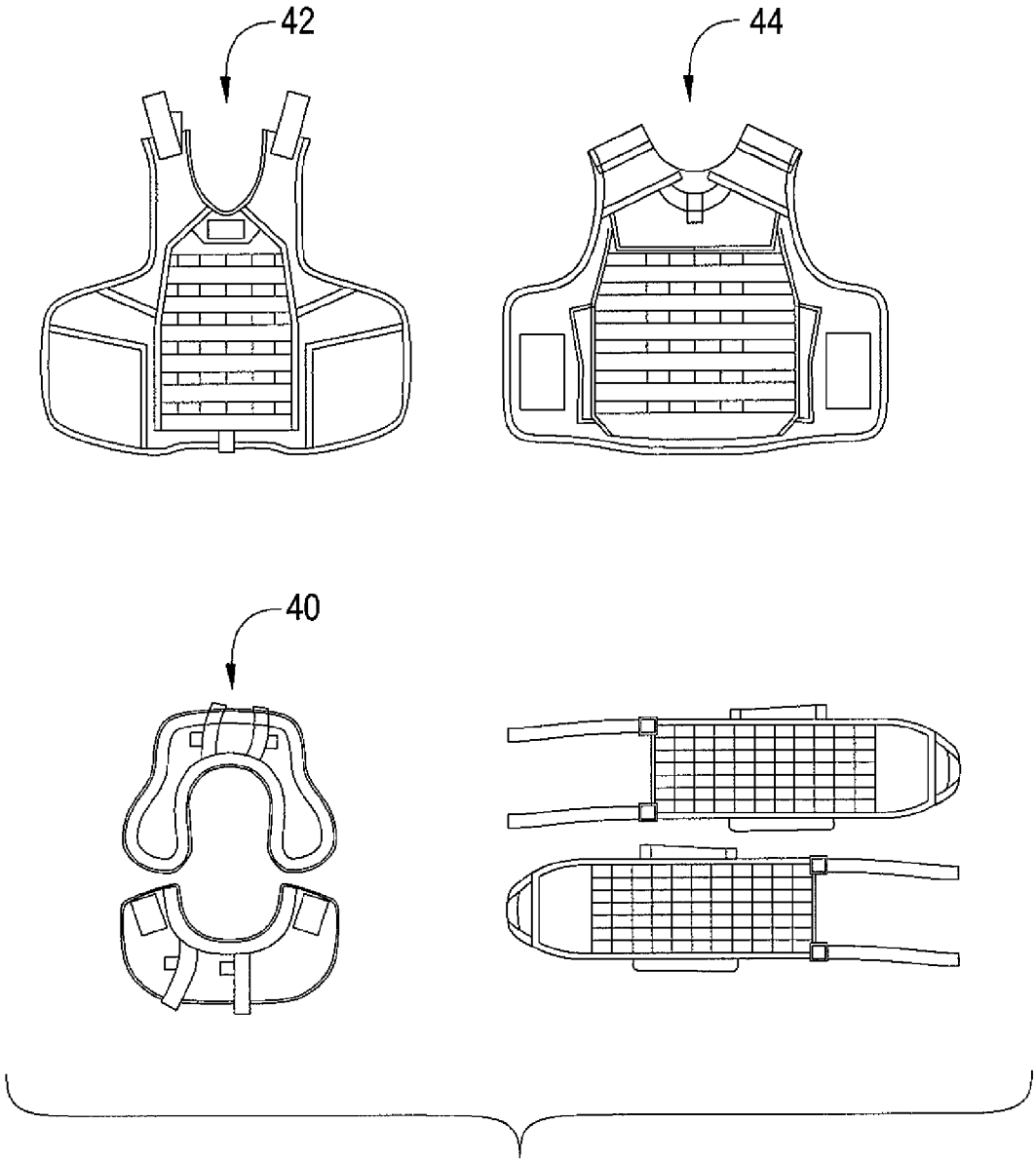
FIG. 2 Prior Art
FIG. 2 shows the various components of one embodiment of a prior art IOTV.

The present disclosure provides, in one embodiment, a firearm stabilization apparatus reversibly attachable to an Improved Outer Tactical Vest, said apparatus including a (i) front portion which further includes a curved medial side, a lateral side, a top portion, a bottom portion, a front panel, a horizontal stabilization brace located proximal to the lateral side, the horizontal stabilization brace comprising a polymer and having a height of approximately 0.25 inch as measured from the front panel, and a vertical stabilization brace both being located proximal to the bottom portion the vertical stabilization brace comprising a polymer and having a height of approximately 0.25 inch as measured from the front panel; (ii) a back portion also including a curved medial side, a lateral side, a top portion, a bottom portion and a shoulder strap passage approximately 0.75 inches square; (iii) at least one hook-and-loop style connector connecting the front portion to the back portion; and (iv) wherein said firearm stabilization apparatus includes a nylon-cotton fabric comprising the Army Combat Uniform camouflage pattern.

In an alternate embodiment, the present disclosure provides a firearm stabilization apparatus including: a front portion, said front portion further comprising a curved medial side, a lateral side, a front panel, a means for stabilizing the firearm in the vertical axis and a means for stabilizing the firearm in the horizontal axis. In yet another embodiment, the present disclosure provides firearm stabilization apparatus comprising a front portion, said front portion further comprising a curved medial side, a lateral side, a front panel and a stabilizing element.

In a further embodiment, the present disclosure provides a method of positioning a shoulder fired firearm, the firearm comprising a butt end, said method comprising the steps of (i) attaching a firearm stabilization apparatus to a body armor where the firearm stabilization apparatus further comprises a horizontal stabilization brace and a vertical stabilization brace; (ii) donning the body armor; and (iii) resting the butt end of the firearm against the firearm stabilization apparatus.

DETAILED DESCRIPTION

The present disclosure provides a firearm stabilization apparatus 2 which allows a user wearing body armor to position and stabilize a firearm in the proper position (i.e., the shoulder pocket) for accurate firing.

In one embodiment the firearm stabilization apparatus 2 includes a front portion 4, a back portion 22 and at least one connector 20 and reversibly attaches to a body armor.

Figure 3:
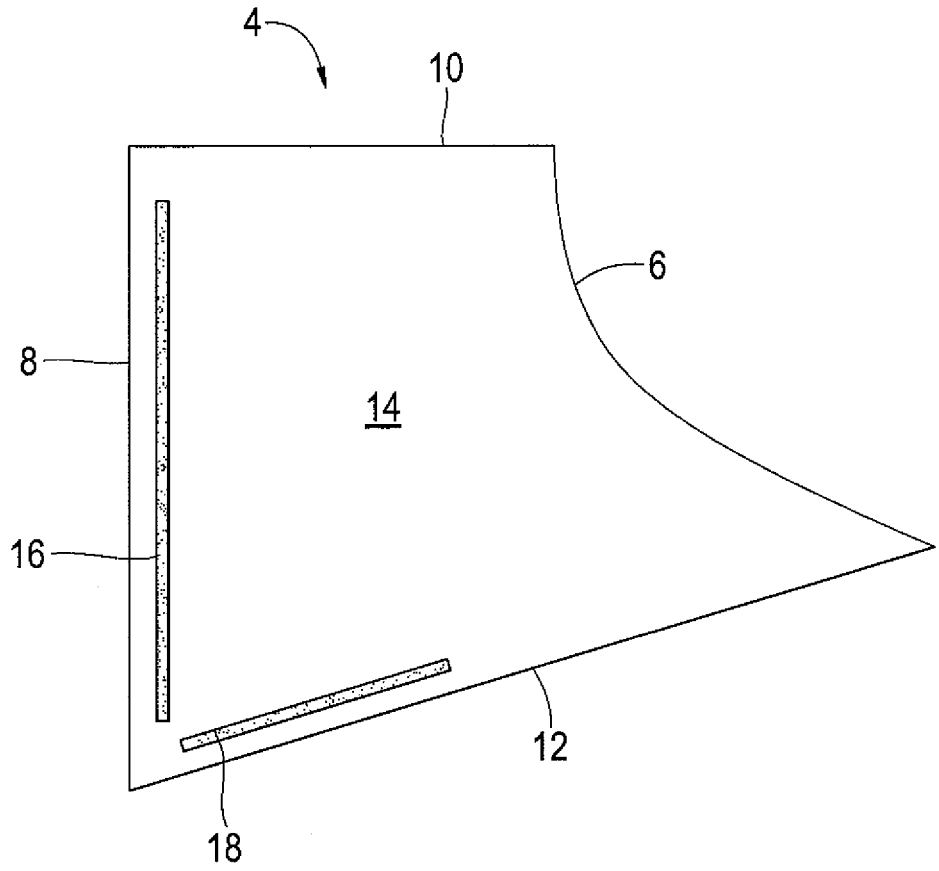
FIG. 3 shows one embodiment of the front portion of the firearm stabilization apparatus.
Figure 4:
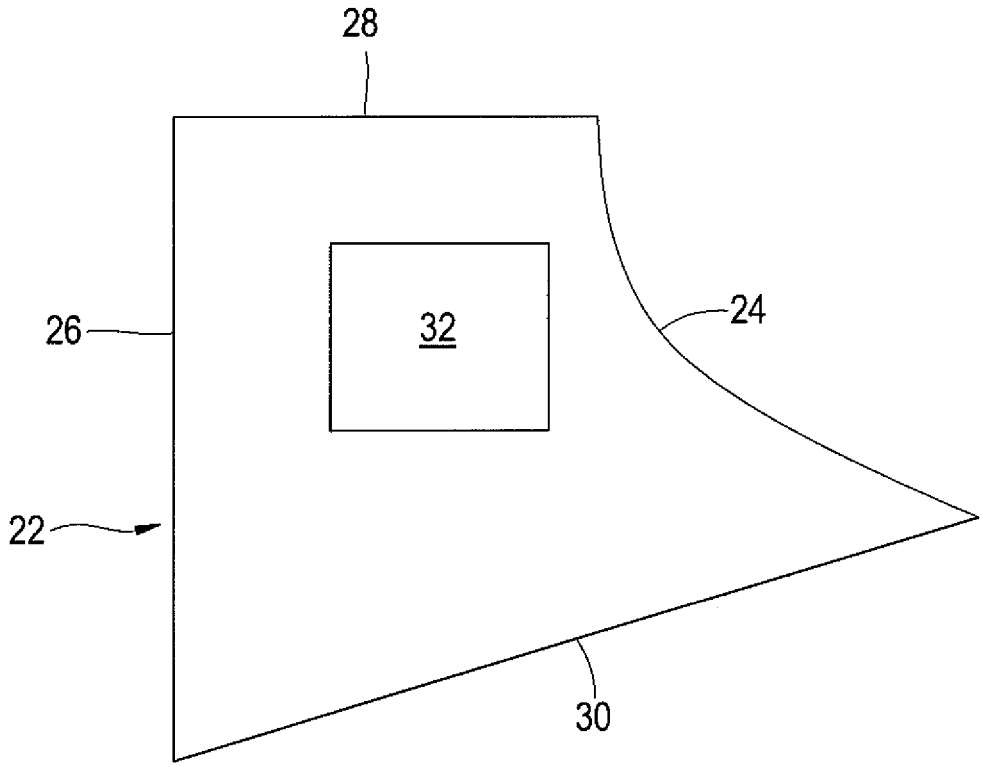
FIG. 4 shows one embodiment of the back portion of the firearm stabilization apparatus.
Figure 5:
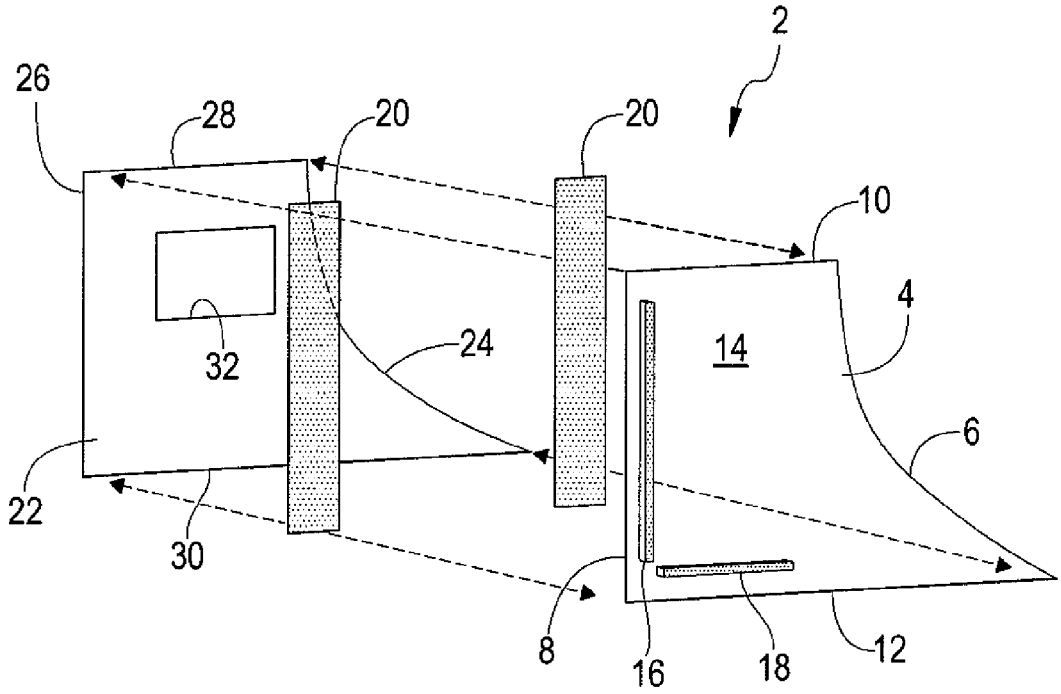
FIG. 5 shows one embodiment of a fully assembled firearm stabilization apparatus.
Figure 6:
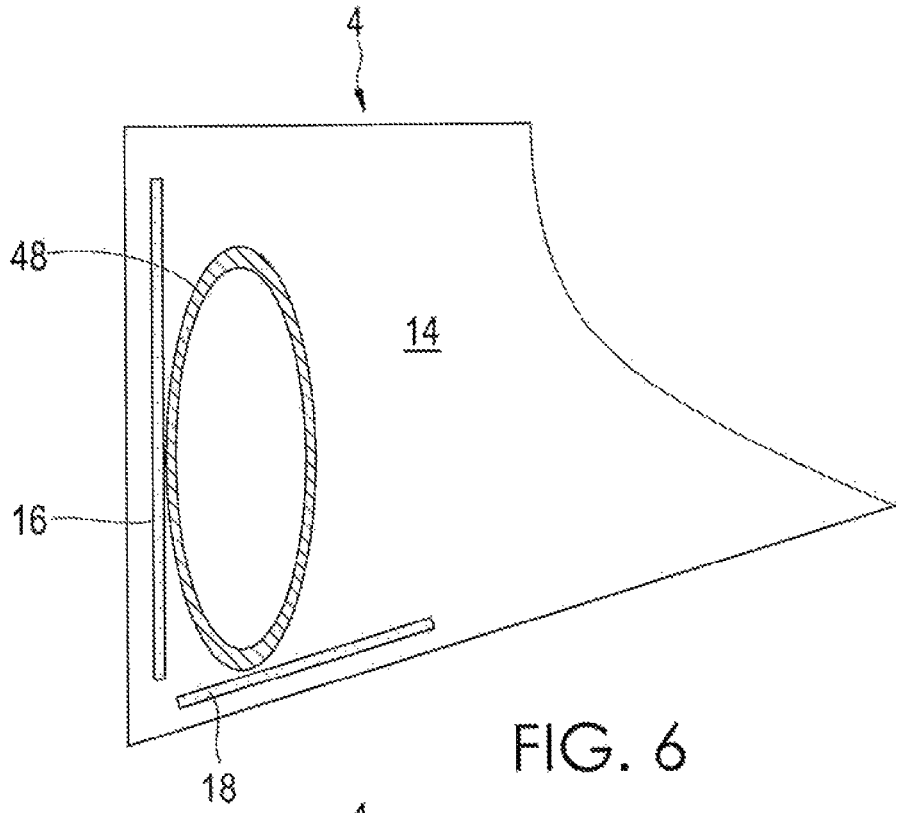
FIG. 6 shows one embodiment of the firearm stabilization apparatus receiving the butt end of a firearm.
Figure 7:
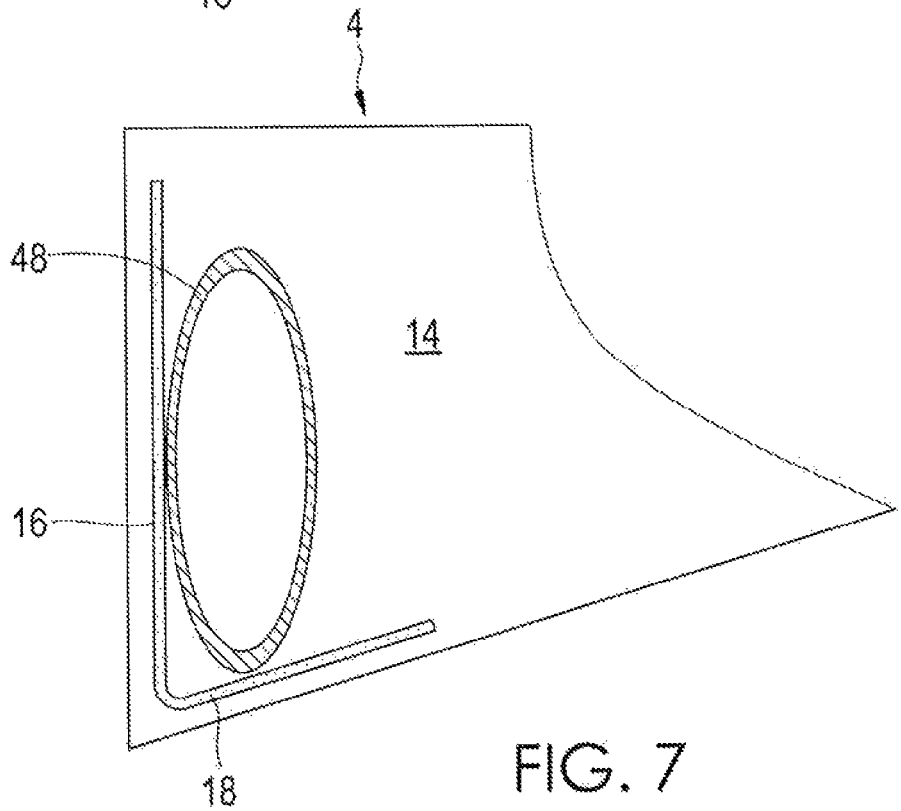
FIG. 7 shows an alternate embodiment of the firearm stabilization apparatus receiving the butt end of a firearm.

In one embodiment shown in FIGS. 3-6, the front portion 4 is a quadrilateral and includes a curved medial side 6, a lateral side 8, an upper portion 10, a lower portion 12 and a front panel 14. In one embodiment, the upper portion 10 also includes a medial and a lateral segment where the lateral segment intersects with the lateral side 8 of the firearm stabilization apparatus 2 in a nearly perpendicular manner forming a right angle. In a further embodiment, the lower portion 12 likewise comprises a medial and a lateral segment where the lateral segment of the lower portion 12 intersects the lateral side 8 of the firearm stabilization apparatus 2 to form an acute angle. The medial segments of the lower portion 12 and the upper portion 10 then intersect with the curved medial side 4 of the firearm stabilization apparatus 2. Generally, as shown in FIG. 3, the upper portion 10 will be shorter than the lower portion 12 thereby allowing the curved medial side 4 and lower portion to form an angle or point where they intersect and creating a curve towards the intersection of the upper portion 10 and the curved medial side 6. In one embodiment the curve mimics or follows the curvature of the head/neck opening of body armor. In a further embodiment, the curve mimics or follows the curvature of the head/neck opening of the IOTV. In one embodiment, as shown in FIGS. 3-5, the lower portion 12 is a straight line from its intersection with the lateral side 6 and the curved medial side 4. In other embodiments (not shown) the lower portion 12 may include one or more steps or angles in the space from its intersection with the lateral side 6 and the curved medial side 4.

The front portion 4 also includes at least one stabilizing element on the front panel 14 which stabilizes the butt of a firearm in the vertical orientation, the horizontal orientation or both (as shown in FIG. 3). In a preferred embodiment shown in FIG. 3, the stabilizing element on the front portion 4 includes a horizontal stabilizing brace 16 and a vertical stabilizing brace 18. The horizontal stabilizing brace 16 serves to prevent the butt of a firearm from moving in the vertical axis while the vertical stabilizing brace 18 serves to prevent the butt of the firearm from moving along the horizontal axis. In other embodiments, the front portion 4 may only include a horizontal stabilizing brace 16 or a vertical stabilizing brace 18. In further embodiment, the horizontal stabilizing brace 16 and vertical stabilizing brace 18 are one contiguous piece of material that extends a distance along the lateral side 8 and the lower portion 12. The stabilization element may generally be located closer to the lateral side 8 of the firearm stabilization apparatus 2 than the curved medial side 6 to allow the user to place the firearm's butt in the user's shoulder pocket.

In one embodiment the horizontal stabilizing brace 16 and a vertical stabilizing brace 18 are approximately 0.25 inches in height (i.e., the top of the braces is approximately 0.25 inches from the front portion 4), although other heights are acceptable and should be considered within the scope of this disclosure. In one embodiment, the horizontal stabilizing brace 16 and a vertical stabilizing brace 18 are different heights. In one preferred embodiment, the horizontal stabilizing brace 16 includes two (2) different segments, a first longer second segment and a second, shorter segment. The first longer segment measures approximately 6.00 inches long, 0.50 inches in width and 0.75 inches in height. The second shorter segment measures approximately 0.50 inches in length, 0.50 inches in width and 0.50 inches in height. In this preferred embodiment, the vertical stabilizing brace 18 also includes two (2) segments, a first connecting segment and a second angled segment. The first connecting segment connect to both the angled segment and the second shorter segment of the horizontal stabilizing brace 16 and measures approximately 1.50 inches in length, 0.50 inches in height and 0.50 inches in width. The second angled segment intersects the first connecting piece to form an angle of approximately 40 degrees and measures approximately 1.25 inches long, 0.50 inches in height and 0.50 inches in width. In one embodiment the braces are made from rubber (natural or synthetic), although other materials known in the art are to be considered within the scope of this disclosure.

In one embodiment, the hack portion 22, as shown in FIG. 4, is substantially a mirror image of the front portion 4 (without the horizontal stabilizing brace 16 and vertical stabilizing brace 18) and has a curved medial side 24, a lateral side 26, an upper potion 28 and a lower potion 30. In one embodiment the back portion includes a shoulder strap passage 32 which allows the user to place the firearm stabilization apparatus 2 on body armor (as described in more detail below) and allows the body armor to be donned in a normal manner. In one embodiment the shoulder strap passage 32 is a square with sides that are approximately 0.75 inches in length, though other shaped and sized shoulder strap passage may be required for different body armor. In this embodiment the shoulder strap passage 32 receives the quick release shoulder straps of the IOTV. In the embodiment where the firearm stabilization apparatus 2 is attached to the IOTV, the shoulder strap passage 32 should be of sufficient size, whether it be a square or other shape, to allow the quick release shoulder straps of the IOTV to function properly. The quick release features of the IOTV are important in that they allow the user to get out of the IOTV quickly when needed such as when a military vehicle rolls over into water and helps medics to treat the injured or wounded quicker.

In an alternate embodiment, the firearm stabilization apparatus 2 includes a front portion 4 as described above and shown in FIG. 3 and a back panel 15 (not shown). In one further embodiment, the firearm stabilization apparatus 2 may be reversibly attached to body minor through various means. In one further embodiment the back panel 15 and the body armor have corresponding hook-and-loop fasteners (or Velcro) whereby the firearm stabilization apparatus 2 is attached to body armor. In one embodiment the body armor is the IOTV. In yet an alternate embodiment, the firearm stabilization apparatus 2 is permanently attached to the body armor, preferably to the left, right or both shoulder regions.

The permanent attachment could be by any method known in the art including sewing, gluing or both.

FIG. 5 shows the general assembly of the firearm stabilization apparatus 2 which includes the front portion 4 and back portion 22 is shown using the connectors 20. In one embodiment the connectors are hook-and-loop fasteners although other embodiments such as nylon webbing, cloth webbing, elastic webbing and other means known to those of skill in the art are to be considered within the scope of this disclosure.

To assemble this embodiment of the firearm stabilization apparatus 2, the back portion 22 and front portion 4 are placed around the shoulder strap 33 of the body protection 34. The back portion 22 should be placed between the shoulder strap 33 and the user while the front portion 4 should be placed in an outward facing direction over the shoulder strap 33 with the stabilizing braces facing outward as well. Then the front portion 4 and rear portions 22 are joined together through the connectors (such as the hook and loop fasteners). In an alternate embodiment the firearm stabilization apparatus 2 is attached to the body protection 34 by simply sliding it over the shoulder strap 33. In both of the prior embodiments the shoulder strap 33 will be passed through the shoulder strap passage 32 on the back portion 22. The body protection 34 then may be worn in a normal manner.

The firearm stabilization apparatus 2 may be constructed from any suitable material. In one embodiment, the firearm stabilization apparatus 2 is constructed from standard Army Combat Uniform Material ("ACU" material). In other embodiments the firearm stabilization apparatus 2 is constructed from material similar to the pattern and material of the body armor on which it is placed. By way of non-limiting example, if the firearm stabilization apparatus 2 is to be used with a black body armor, the firearm stabilization apparatus 2 may be constructed from a black material.

In some embodiments, the front portion 4 may include a non-slip surface which further helps stabilize the firearm. The non-slip surface may include rubber (natural or synthetic) or siliconized compounds.

In one embodiment as shown in FIGS. 3-6, the firearm stabilization apparatus 2 is designed to be worn with the IOTV. In other embodiments, the firearm stabilization apparatus 2 may be worn with the Marine Modern Tactical Vest (MTV), Improved Ballistic Armor (IBA) or soft armors constructed from Kevlar®, Kevlar 29®, Kevlar Protera® (all available from E.I. du Pont de Nemours), Spectra® fiber (available from Allied Signal), Gold Shield® (also available from Allied Signal), TWARON® (available from Akzo Nobel) or Dragon Skin® Armor from Pinnacle Armor. Of course, the firearm stabilization apparatus 2 may adapted for use with future body armors as well including without limitation the Soldier Plate Carrier® from KDH Defense Systems, the Rampage, the Coyote Chameleon® Tactical Vest from ArchAngel, Inc.

The dimensions of the firearm stabilization apparatus 2 may be altered to coincide with different sizes of body armor. Typically, body armor may come in a small, medium, large or extra-large size and the overall dimensions of the firearm stabilization apparatus 2 may be altered to provide the correct fit with a certain size of body armor. In one embodiment, to correctly fit and function with a size large IOTV, the lateral side 8 is approximately 9.00 inches in length, the upper portion 10 is approximately 3.00 inches in length and the lower portion 12 is approximately 6.00 inches in length. The dimensions of back portion 22 may substantially mirror the dimensions of the front portion 4. In further embodiments, the dimensions of the firearm stabilization apparatus 2 may be altered to fit different types of body armor, by way of non-limiting example, a firearm stabilization apparatus 2 that fits a large size IOTV may be of different dimensions than one that fits a large size Marine MTV.

While the invention has been described with respect to a limited number of embodiments, those skilled in the art, having benefit of this disclosure, will appreciate that other embodiments can be devised which do not depart from the scope of the invention as disclosed here.

I claim:

1. An apparatus reversibly attachable to an Improved Outer Tactical Vest, said apparatus comprising:

a. a front portion comprising
  i. a curved medial side,
  ii. a lateral side,
  iii. a top portion,
  iv. a bottom portion,
  v. a front panel,
  vi. a horizontal stabilization brace located proximal to the lateral side and attached to the front panel, the horizontal stabilization brace comprising a polymer and having a height of 0.25 inch as measured from the front panel,
  vii. and a vertical stabilization brace both being located proximal to the bottom portion and attached to the front panel, the vertical stabilization brace comprising a polymer and having a height of 0.25 inch as measured from the front panel; wherein the horizontal stabilization brace and the vertical stabilization brace form a shoulder fired firearm butt receiving pocket, said pocket being positioned between the vertical and horizontal stabilization braces, wherein the pocket is configured to stabilize a shoulder fired firearm during the firing of said firearm;

b. a back portion comprising
  i. a curved medial side,
  ii. a lateral side,
  iii. a top portion,
  iv. a bottom portion and
  v. a shoulder strap passage 0.75 inches square;

c. at least one hook-and-loop style connector connecting the front portion to the back portion; and d. wherein said firearm stabilization apparatus further comprises a nylon-cotton fabric comprising the Army Combat Uniform camouflage pattern.

2. An apparatus comprising:

a. a front portion, said front portion further comprising
  i. a curved medial side,
  ii. a lateral side,
  iii. a front panel,
  iv. a means for stabilizing a shoulder fired firearm in the vertical axis, said means being attached to the front panel, and
  v. a means for stabilizing the shoulder fired firearm in the horizontal axis, said means being attached to the front panel, wherein the means for stabilizing the firearm in the vertical axis and the means for stabilizing the firearm in the horizontal axis form a firearm butt receiving pocket, said pocket being located medicated the means for stabilizing the firearm in the horizontal axis and above the means for stabilizing the firearm in the vertical axis, wherein the apparatus is configured to stabilize a shoulder fired firearm in both the horizontal and vertical axes during the firing of said firearm.

3. The apparatus of claim 2 where the apparatus comprises material in Army Combat Uniform camouflage pattern.

4. The apparatus of claim 2 further comprising a means for reversibly attaching the apparatus to a body armor.

5. The apparatus of claim 2 where the means for stabilizing the firearm in the horizontal axis is a distinct vertical stabilizing brace.

6. The apparatus of claim 2 where the means for stabilizing the firearm in the vertical axis is a distinct horizontal stabilizing brace.

7. The apparatus of claim 2 where the means for stabilizing the firearm is in the vertical and horizontal axis is a single contiguous ridge.

8. The apparatus of claim 4 where the body armor is the Improved Outer Tactical Vest.

9. The apparatus of claim 4 where the body armor is the Marine Modern Tactical Vest.

10. The apparatus of claim 2 further comprising a back portion and at least one connector.

11. The apparatus of claim 10 where the hack portion further comprises a curved medial side, a lateral side, a top portion, a bottom portion and a shoulder strap passage.

12. The apparatus of claim 10 where the connector is a hook and loop connector.

* * * * *